US012110760B2

(12) United States Patent
Bouthilet et al.

(10) Patent No.: US 12,110,760 B2
(45) Date of Patent: Oct. 8, 2024

(54) WELLBORE CEMENTING USING A BURST DISC SUB AND REVERSE CIRCULATION

(71) Applicant: Chevron U.S.A. Inc., San Ramon, CA (US)

(72) Inventors: Kyle Tate Bouthilet, Houston, TX (US); Cody Jamail Leathers, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/318,356

(22) Filed: May 16, 2023

(65) Prior Publication Data

US 2023/0383618 A1 Nov. 30, 2023

Related U.S. Application Data

(60) Provisional application No. 63/346,496, filed on May 27, 2022.

(51) Int. Cl.
*E21B 33/14* (2006.01)
*E21B 34/06* (2006.01)

(52) U.S. Cl.
CPC ..... *E21B 33/14* (2013.01); *E21B 34/063* (2013.01)

(58) Field of Classification Search
CPC ..... E21B 33/14; E21B 34/063
See application file for complete search history.

(56) References Cited

U.S. PATENT DOCUMENTS 5,924,696 A * 7/1999 Frazier ..... E21B 34/063 166/188
2007/0251698 A1* 11/2007 Gramstad ..... E21B 34/063 166/376
2011/0048713 A1* 3/2011 Lewis ..... E21B 33/14 166/292
2015/0068730 A1* 3/2015 Frazier ..... E21B 34/063 166/181

FOREIGN PATENT DOCUMENTS

WO WO-2021195753 A1 * 10/2021 ..... E21B 34/06

* cited by examiner

*Primary Examiner* — James G Sayre
(74) *Attorney, Agent, or Firm* — Smith & Woldesenbet Law Group, PLLC

(57) ABSTRACT

A system for cementing casing using reverse circulation, where the system can include a casing string having multiple casing pipes and a burst disc sub, where the burst disc sub includes a burst disc that is disposed within a cavity formed in the casing string and prevents unwanted flow up the cavity while running casing, where the burst disc, when exposed to a downward force in the cavity exceeding a threshold value, is configured to break apart to allow flow of casing fluid under pressure from the upper portion to the lower portion of the cavity through the burst disc sub, and where the burst disc sub is configured to allow for reverse flow of the casing fluid therethrough when a cement slurry is injected down an annulus formed between the casing string and a formation wall of a wellbore.

19 Claims, 11 Drawing Sheets

WELLBORE CEMENTING USING A BURST DISC SUB AND REVERSE CIRCULATION

CROSS-REFERENCE TO RELATED APPLICATIONS

This application claims priority under 35 U.S.C. § 119 to U.S. Provisional Patent Application Ser. No. 63/346,496, titled "WELLBORE CEMENTING USING A BURST DISC SUB AND REVERSE CIRCULATION" and filed on May 27, 2022, the entire contents of which are hereby incorporated herein by reference.

TECHNICAL FIELD

The present application is related to wellbore cementing operations and, more particularly, to wellbore cementing using a burst disc sub and reverse circulation.

BACKGROUND

During drilling and completions operations of a hydrocarbon producing wellbore, well casing (also called a casing string) is typically run to a desired depth after drilling a wellbore, and then cement is generally used to solidify the casing string within the drilled wellbore. During the cementing operation, a cement slurry is pumped downhole to end up between the casing string and the wellbore. Sometimes the cement slurry is pumped through the length of the inner bore (cavity) of the casing string, out the end, and up through the annulus. Other times, in what is called reverse circulation, the cement slurry is pumped down the annulus until the cement slurry accumulates at the bottom and begins to fill the cavity of the casing string. In either case, once the cement slurry hardens, the resulting hardened cement bonds the casing string to the surrounding rock formation to provide support and strength to the well casing. In addition, the hardened cement forms a seal between the well casing and the wellbore to protect oil-producing zones and non-oil-producing zones from contamination.

A rig is used to insert the casing string into the wellbore. The rig is also used for a number of other steps in a casing operation, regardless of the method used. The use of a rig is expensive. Also, when other wellbores in a common pad are being drilled or planned for drilling, a single rig may be allocated to those multiple wellbores. As a result, keeping the rig at one wellbore for a longer period of time to perform a casing operation can prevent at least one other wellbore that is part of the pad from being developed sooner. In other words, in addition to the overall cost of using the rig for longer periods of time, keeping the rig for longer periods of time at one well can create a lost opportunity cost for the other wells of the pad.

SUMMARY

In general, in one aspect, the disclosure relates to a system for cementing casing using reverse circulation. The system can include a casing string disposed in a wellbore, where the casing string can include a plurality of casing pipes and a burst disc sub coupled to and disposed between two of the plurality of casing pipes toward a distal end of the casing string. The burst disc sub can include a burst disc that is disposed within a cavity formed in the casing string, where the burst disc provides a physical barrier in the cavity dividing the cavity into an upper portion and a lower portion when the burst disc is in a default state, where the burst disc, when exposed to a downward force in the upper portion of the cavity exceeding a threshold value, is configured to break apart to allow flow of casing fluid under pressure from the upper portion to the lower portion of the cavity through the burst disc sub, and where the burst disc sub is configured to allow for reverse flow of the casing fluid therethrough when a cement slurry is injected down an annulus formed between the casing string and a formation wall of the wellbore.

In another aspect, the disclosure relates to a method for cementing casing using reverse circulation for cementing with a burst disc as an internal barrier. The method can include injecting a casing fluid under pressure from a surface into a cavity of a casing string disposed in a wellbore, where the casing string includes a plurality of casing pipes and a burst disc sub that is coupled to and disposed between two of the plurality of casing pipes toward a distal end of the casing string, where the burst disc sub includes a burst disc that is disposed within a cavity formed by the casing string, where the burst disc provides a physical barrier in the cavity dividing the cavity into an upper portion and a lower portion when the burst disc is in a default state, and where the burst disc breaks apart after the casing fluid under pressure contacts the burst disc to allow flow of the casing fluid from the upper portion to the lower portion of the cavity through the burst disc sub. The method can also include injecting, after the casing fluid flows out of an annulus formed between the casing string and a formation wall of the wellbore at the surface, a cement slurry into the annulus at the surface until the cement slurry flows into the cavity at the distal end of the casing string.

In yet another aspect, the disclosure relates to a burst disc sub of a casing string. The burst disc sub can include a body having a wall that forms a cavity, where a first end of the body is configured to couple to a first casing pipe in the casing string, and where a second end of the body is configured to couple to a second casing pipe in the casing string. The burst disc sub can also include a burst disc coupled to an inner surface of the wall, where the burst disc provides a physical barrier in the cavity dividing the cavity into an upper portion and a lower portion when the burst disc is in a default state, where the burst disc, when exposed to a force from above in the cavity exceeding a threshold value, is configured to break apart, and where the body is configured to allow for reverse flow of casing fluid therethrough when a cement slurry is injected down an annulus formed between the casing string and a formation wall of a wellbore.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1A:
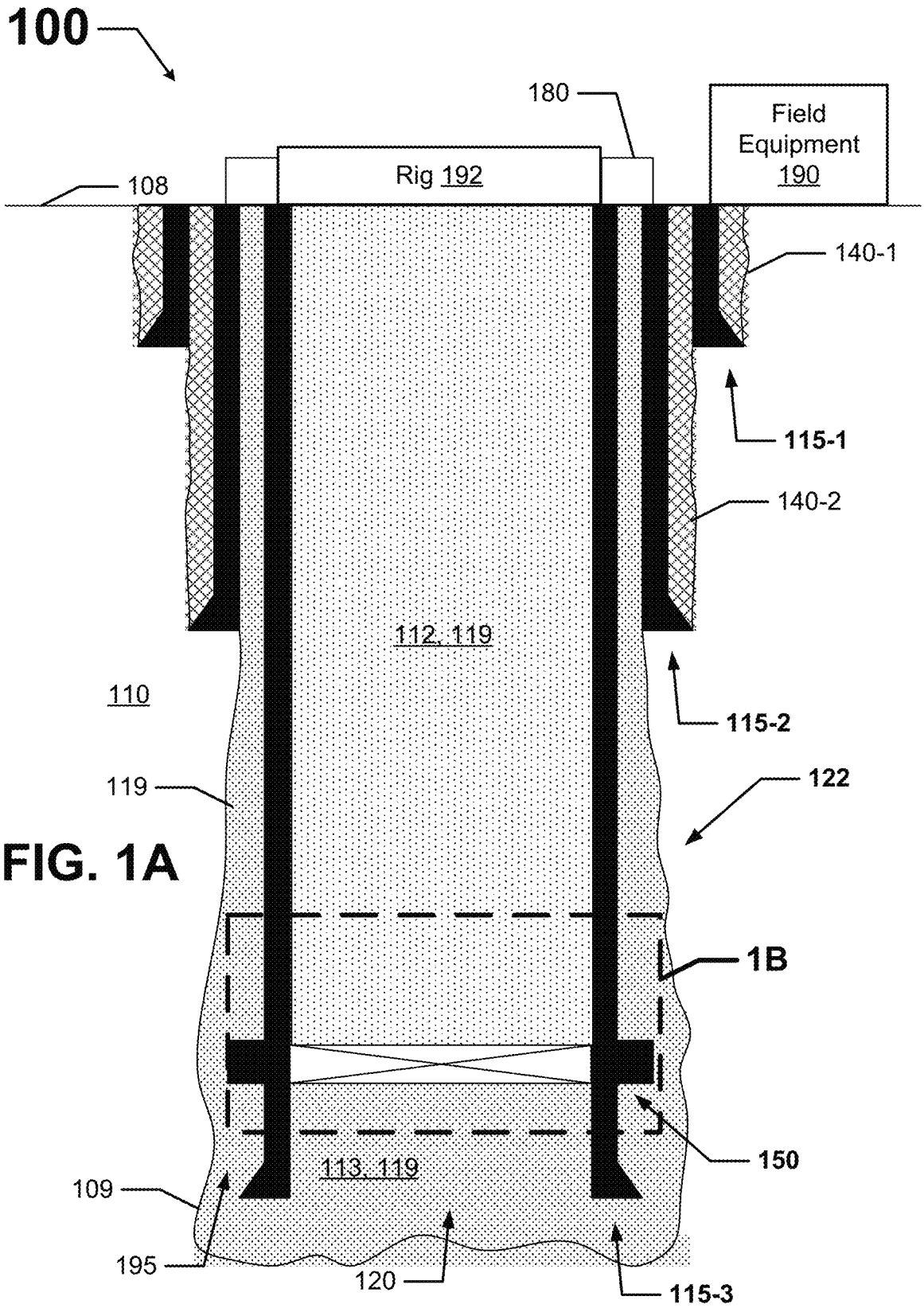
FIGS. 1A and 1B show sectional views of a system for performing a wellbore cementing operation when a casing string is inserted into a wellbore according to certain example embodiments.

The example embodiments discussed herein are directed to systems, methods, and devices for wellbore cementing using a burst disc sub and reverse circulation. Wellbores that undergo cementing operations for which example embodiments are used can be drilled and completed to extract a subterranean resource. Examples of a subterranean resource can include, but are not limited to, natural gas, oil, and water. Wellbores for which example embodiments are used for cementing operations can be land-based or subsea. Example embodiments for wellbore cementing using a burst disc sub and reverse circulation can be rated for use in hazardous environments.

Example embodiments can include multiple components that are described herein, where a component can be made from a single piece (as from a mold or an extrusion). When a component (or portion thereof) of an example embodiment for wellbore cementing using a burst disc sub and reverse circulation is made from a single piece, the single piece can be cut out, bent, stamped, and/or otherwise shaped to create certain features, elements, or other portions of the component. Alternatively, a component (or portion thereof) of an example embodiment for wellbore cementing using a burst disc sub and reverse circulation can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from merely coupling. In addition, each component and/or feature described herein (including each component of an example casing string, such as a burst disc sub) can be made of one or more of a number of suitable materials, including but not limited to metal (e.g., stainless steel), ceramic, rubber, glass, and plastic.

A coupling feature (including a complementary coupling feature) as described herein can allow one or more components (e.g., a housing) and/or portions of an example embodiment for wellbore cementing using a burst disc sub and reverse circulation to become mechanically coupled, directly or indirectly, to another portion of the example embodiment for wellbore cementing using a burst disc sub and reverse circulation and/or a component of a larger system. A coupling feature can include, but is not limited to, a portion of mating threads, a hinge, an aperture, a recessed area, a protrusion, a slot, and a detent. One portion of an example mating threads can be coupled to another portion of the example embodiment for wellbore cementing using a burst disc sub and reverse circulation and/or a component of a larger system by the direct use of one or more coupling features.

In addition, or in the alternative, a portion of an example embodiment for wellbore cementing using a burst disc sub and reverse circulation can be coupled to another portion of the example embodiment for wellbore cementing using a burst disc sub and reverse circulation and/or a component of a larger system using one or more independent devices that interact with one or more coupling features disposed on a component of the example embodiment for wellbore cementing using a burst disc sub and reverse circulation. Examples of such devices can include, but are not limited to, a fastening device (e.g., a bolt, a screw, a rivet), a pin, a hinge, an adapter, and a spring. One coupling feature described herein can be the same as, or different than, one or more other coupling features described herein. A complementary coupling feature as described herein can be a coupling feature that mechanically couples, directly or indirectly, with another coupling feature.

When used in certain systems (e.g., for certain subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Also, as discussed above, example embodiments for wellbore cementing using a burst disc sub and reverse circulation can be used in hazardous environments, and so example embodiments for wellbore cementing using a burst disc sub and reverse circulation can be designed to comply with industry standards that apply to hazardous environments.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit or a four-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments for wellbore cementing using a burst disc sub and reverse circulation and related systems for wellbore cementing operations will be described more fully hereinafter with reference to the accompanying drawings, in which example embodiments for wellbore cementing using a burst disc sub and reverse circulation and related systems for wellbore cementing operations are shown. Example embodiments for wellbore cementing using a burst disc sub and reverse circulation and related systems for wellbore cementing operations may, however, be embodied in many different forms and should not be construed as limited to the example embodiments set forth herein. Rather, these example embodiments are provided so that this disclosure will be thorough and complete, and will fully convey the scope of wellbore cementing using a burst disc sub and reverse circulation and related systems for wellbore cementing operations to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of wellbore cementing using a burst disc sub and reverse circulation and related systems for wellbore cementing operations. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
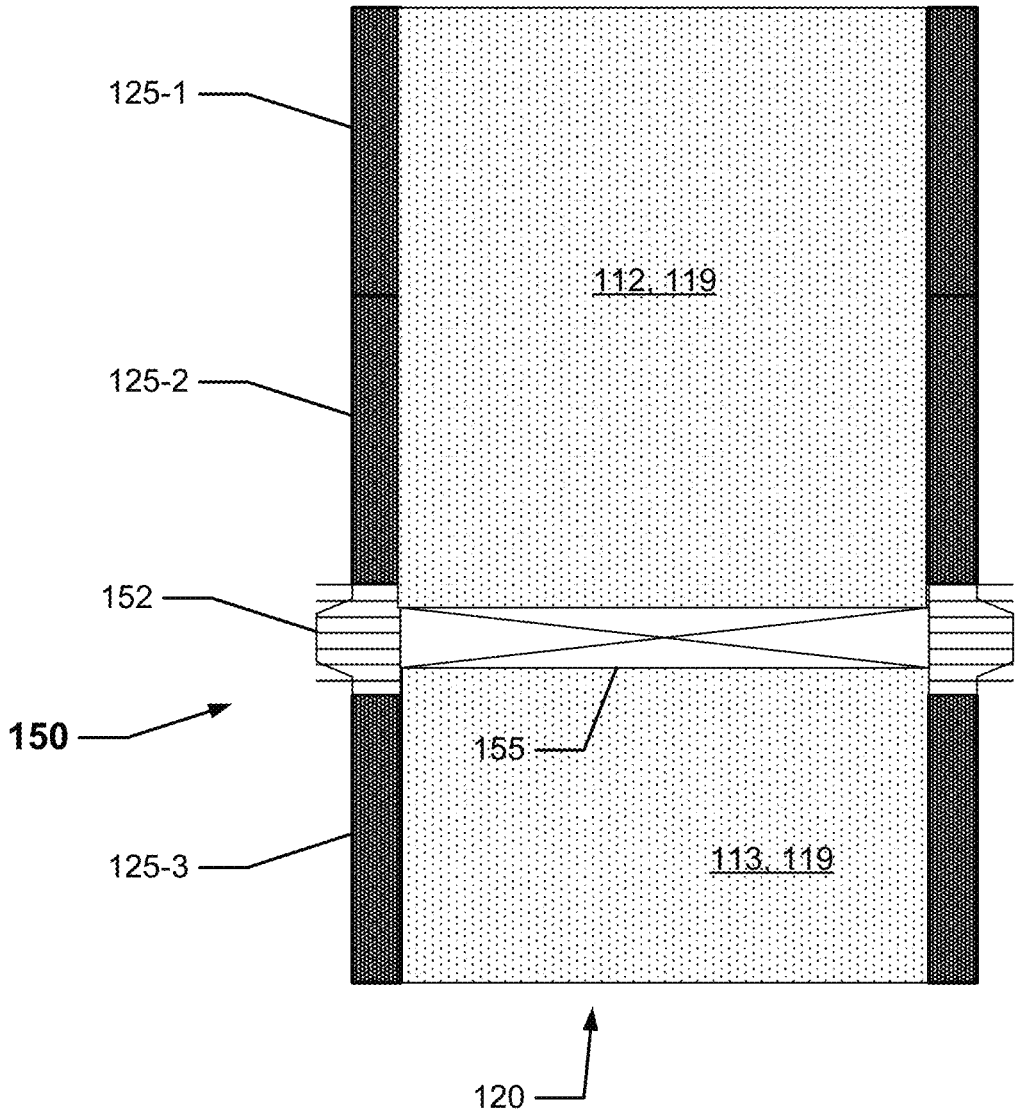

FIGS. 1A and 1B show sectional views of a system 100 for performing a wellbore cementing operation when a casing string 115-3 is inserted into a wellbore according to certain example embodiments. Specifically, FIG. 1A shows a sectional view of the system 100, and FIG. 1B shows a detailed sectional view of the casing string 115-3. The system 100 of FIG. 1A shows a wellbore 122 drilled into a subterranean formation 110. The wellbore 122 is defined by a wall 109. The wellbore 122 is drilled using a rig 192 (e.g., a derrick, a tool pusher, a clamp, a tong) and field equipment 190 (e.g., drill pipe, casing pipe, a drill bit, a fluid pumping system).

Some of this field equipment 190 is located above a surface 108, and other parts of the field equipment 190 is located within the wellbore 122 as the wellbore 122 is developed. For example, the system 100 of FIG. 1 shows that one or more casing valves 180 have been installed at the top of the annulus 195 at the surface 108. A casing valve 180 can be installed using field equipment 190 and can be part of the wellhead. A casing valve 180 can regulate the flow of a fluid (e.g., casing fluid 119, a cement slurry) into or out of the annulus 195. Once the wellbore 122 (or a section thereof) is drilled, the casing string 115-3 is inserted into the wellbore 122 and subsequently cemented to the wellbore 122 to stabilize the wellbore 122 and allow for the extraction of subterranean resources (e.g., oil, natural gas) from the subterranean formation 110.

At the point in time captured in FIG. 1A, the casing string 115-3 is the third inserted into the wellbore 122. Already inserted and cemented to the subterranean formation 110, at point in time prior to the time captured in FIG. 1A, are casing string 115-1 and casing string 115-2. Casing string 115-1 is cemented to the subterranean formation 110 by hardened cement 140-1, and casing string 115-2 is cemented to the subterranean formation 110 by hardened cement 140-2. The process used to cement the casing string 115-1 and the casing string 115-2 can be the same as the example process used to cement the casing string 115-3, as discussed below. The casing string 115-1 is cemented at a point in time that proceeds the point in time when the casing string 115-2 is cemented.

The surface 108 can be ground level for an on-shore (also called land-based) application (as in this case) and the sea floor for an off-shore application. The point where the wellbore 122 begins at the surface 108 can be called the entry point. While not shown in FIG. 1A, there can be multiple wellbores 122, each with their own entry point but that are located close to the other entry points, drilled into the subterranean formation 110. In such a case, the multiple wellbores 122 can be drilled at the same pad location using the same rig 192 and, in some cases, at least some of the same field equipment 190.

The subterranean formation 110 can include one or more of a number of formation types, including but not limited to shale, limestone, sandstone, clay, sand, and salt. In certain embodiments, a subterranean formation 110 can include one or more reservoirs in which one or more subterranean resources (e.g., oil, gas, water, steam) can be located. One or more of a number of field operations (e.g., fracking, coring, tripping, drilling, cementing casing, extracting downhole resources) can be performed to reach an objective of a user with respect to the subterranean formation 110.

The wellbore 122 can have one or more of a number of segments, where each segment can have one or more of a number of dimensions. Examples of such dimensions can include, but are not limited to, size (e.g., diameter) of the wellbore 122, a curvature of the wellbore 122, a total vertical depth of the wellbore 122, a measured depth of the wellbore 122, and a horizontal displacement of the wellbore 122. As in this case, the wellbore 122 can also undergo multiple cementing operations, where each cementing operation covers part or all of a segment of the wellbore 122 or multiple segments of the wellbore 122.

As discussed above, inserted into and disposed within the wellbore 122 of FIG. 1A is a casing string 115-3. As shown by way of example in FIG. 1B, the casing string 115-3 includes at least one burst disc sub 150 and a number of casing pipes 125 (e.g., casing pipe 125-1, casing pipe 125-2, casing pipe 125-3) that are coupled to each other end-to-end to form the casing string 115-3. Each end of a casing pipe 125 and the burst disc sub 150 has mating threads (a type of coupling feature) disposed thereon, allowing a casing pipe 125 to be mechanically coupled to another casing pipe 125 and/or the burst disc sub 150 in an end-to-end configuration. The burst disc sub 150 and the casing pipes 125 of the casing string 115-3 can be mechanically coupled to each other directly or indirectly using a coupling device, such as a coupling sleeve. In the portion of the casing string 115-3 shown in FIG. 1B, casing pipe 125-1 is directly coupled to casing pipe 125-2, which is directly coupled to the burst disc sub 150, which is directly coupled to casing pipe 125-3.

Each casing pipe 125 of the casing string 115-3 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of a casing pipe 125 is circular, which is commonly the case, the width can refer to an outer diameter, an inner diameter, or some other form of measurement of the casing pipe 125. Examples of a width in terms of an outer diameter of a casing pipe 125 can include, but are not limited to, 4½ inches, 7 inches, 7⅝ inches, 8⅝ inches, 10¾ inches, 13⅜ inches, and 14 inches. Typically, as in this case, the larger widths of the casing pipe 125 (as for casing string 115-1 and casing string 115-2) are closer to the entry point at the surface 108, and the width gradually decreases by segment moving toward the distal end of the wellbore 122.

The burst disc sub 150 includes a body 152 and a burst disc 155. The body 152 can have a wall that forms a cavity, which becomes part of the cavity 120 when the burst disc sub 150 is part of the casing string 115-3. The first (e.g., top) end of the body 152 of the burst disc sub 150 is coupled to casing pipe 125-2 in the casing string 115-3, and a second (e.g., bottom) end of the body 152 is coupled to casing pipe 125-3 in the casing string 115-3. The burst disc 155 is coupled to an inner surface of the wall of the body 152. When the burst disc 155 is in a default state, as shown in FIGS. 1A and 1B, the burst disc 155 provides a physical barrier in the cavity 120, dividing the cavity 120 into an upper portion 112 and a lower portion 113.

When the burst disc 155 is exposed to a force exceeding a threshold value, the burst disc 155 is configured to break apart. When this occurs, the upper portion 112 and the lower portion 113 of the cavity 120 become continuous. Once the burst disc 155 breaks apart, flow of one or more fluids (e.g., casing fluid, cement slurry) can flow in either direction (i.e., in a forward direction (down the cavity 120 and up the annulus 195 formed between the casing string 115-3 and the casing string 115-2 from the surface 108 to the distal end of the casing string 115-2 and between the casing string 115-3 and the formation wall 109 of the wellbore 122 for the remainder of the wellbore 122), in a reverse direction (down the annulus 195 and up the cavity 120). As discussed below, the burst disc 155 can be broken apart without the rig 192 in place above an opening of the wellbore 122. Similarly, the burst disc 155 can be broken apart while the rig 192 remains in place above the opening of the wellbore 122.

The size (e.g., width, length) of a casing string 115 (e.g., casing string 115-3) can be based on the information gathered using field equipment 190 with respect to the subterranean wellbore 122. As discussed above, the walls of the casing pipes 125 and the burst disc sub 150 of the casing string 115-3 have an inner surface that form a cavity 120 that traverses the length of the casing string 115-3, except when the burst disc 155 of the burst disc sub 150 is in a default state, in which case the cavity 120 is divided into an upper portion 112 and a lower portion 113. Each casing pipe 125 and the burst disc sub 150 of the casing string 115-3 can be made of one or more of a number of suitable materials, including but not limited to stainless steel. In some cases, a casing pipe 125 and/or the burst disc sub 150 of the casing string 115-3 can have a collar.

In some cases, in the annulus 195 formed between the outer surface of the casing string 115-3 and the wall 109 of the wellbore 122, stabilizers (not shown) or similar devices can be inserted along with the casing pipes 125 and/or the burst disc sub 150, and/or integrated with one or more of the casing pipes 125 and/or the burst disc sub 150. In this example, as shown in FIG. 1B, a stabilizer is integrated with the body 152 of the burst disc sub 150. These stabilizers help to keep the casing string 115-3 relatively centered within the wellbore 122.

Figure 7:
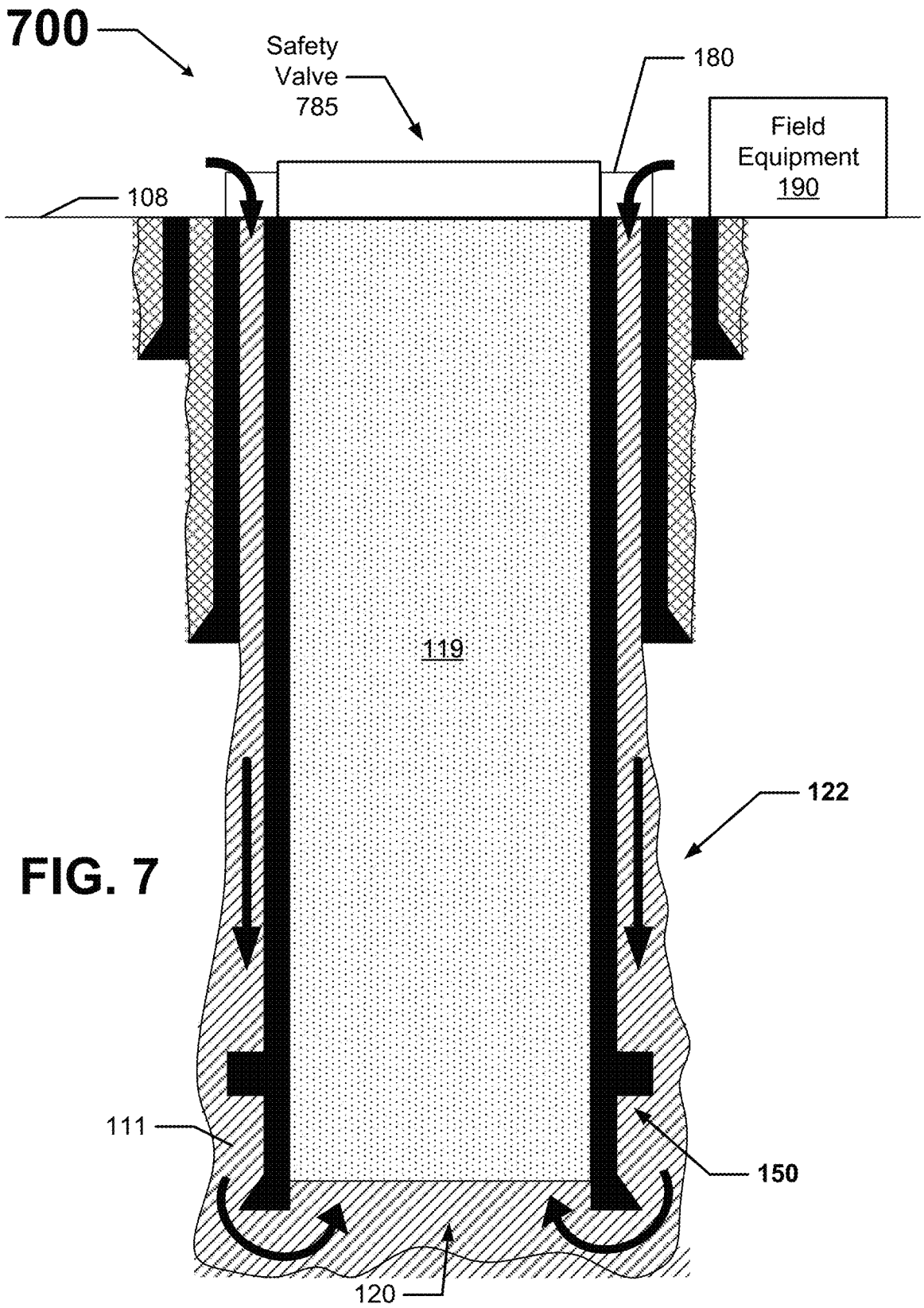
Figure 8:
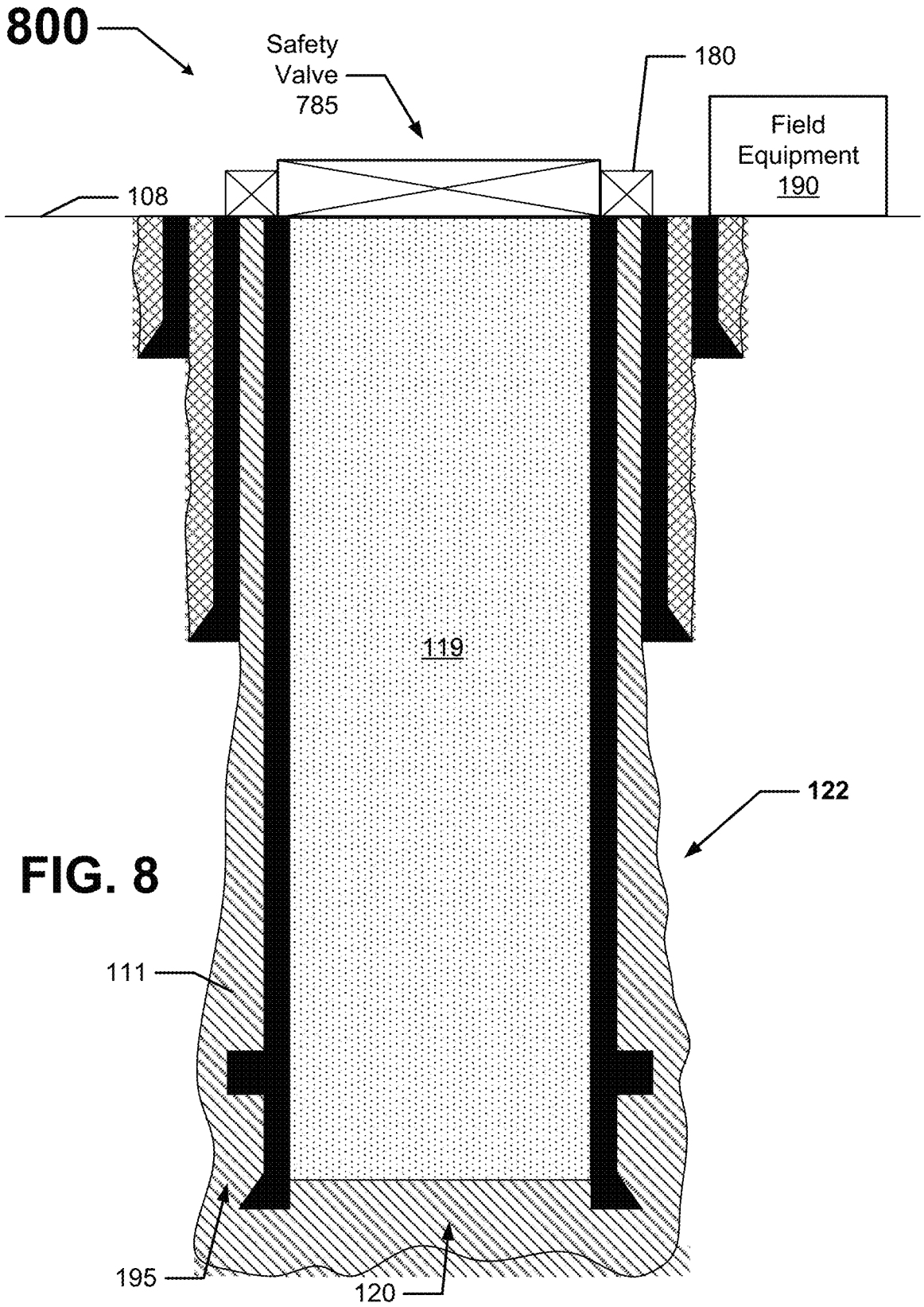
Figure 9:
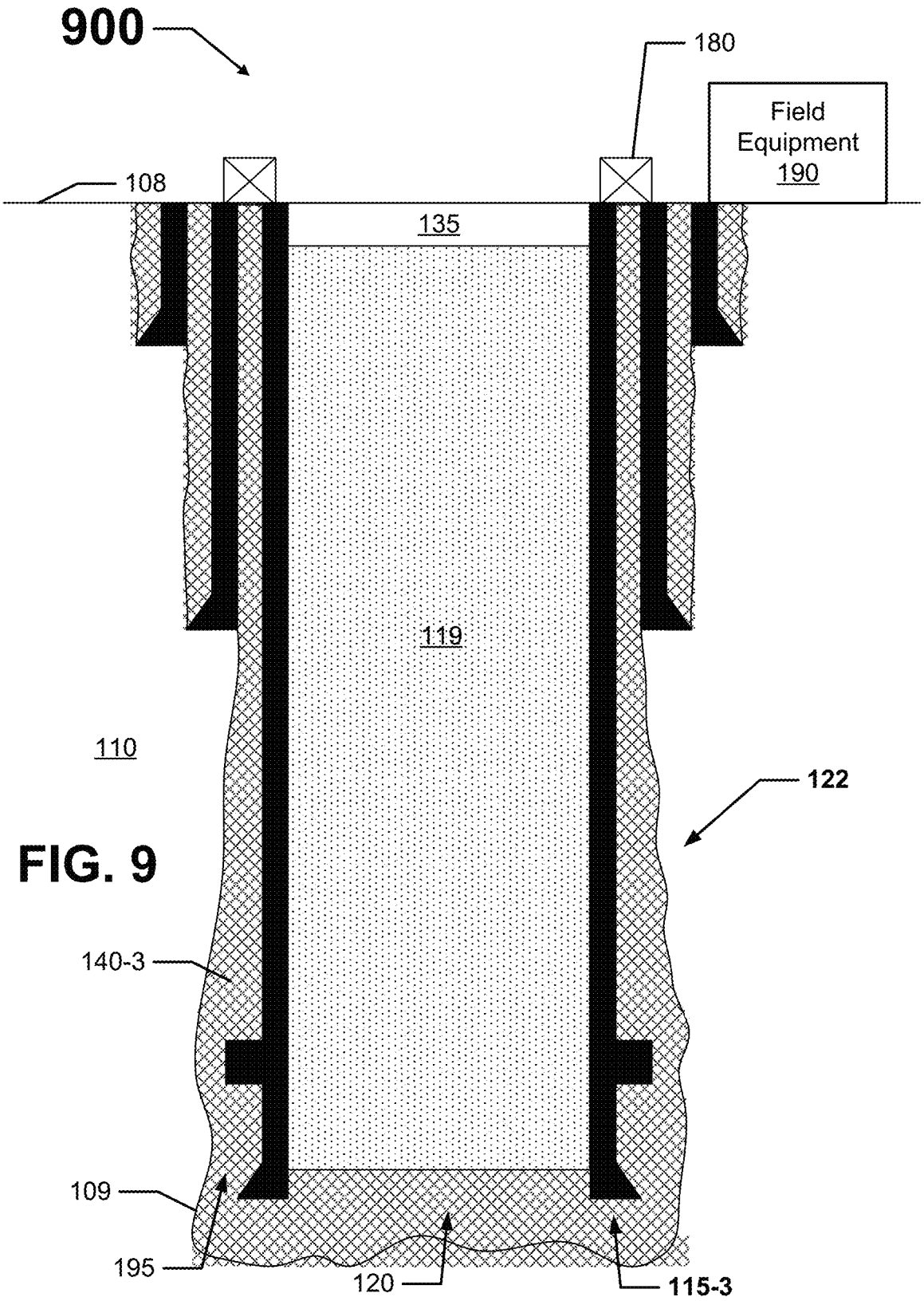

The goal of a cementing operation is to put wet cement (also called a cement slurry) in the annulus 195, and for the cement slurry to cure into hardened cement 140. Specialized equipment (part of the field equipment 190), positioned at the surface 108 near the entry point of the wellbore 122, can be used in a subterranean cementing operation. Such field equipment 190 can include, but is not limited to, mixers, pumps, storage tanks, motors, generators, and piping. When the cement slurry sets and dries, a secure bond is created between the subterranean formation 110 and the casing string 115. In some cases, a cement slurry is poured or pumped into the cavity 120 of the casing string 115-3 using the field equipment 190, and then the cement slurry is forced at the bottom of the casing string 115-3 upward into the annulus 195. Alternatively, as used with example embodiments, and as shown in FIGS. 7 through 9 below, a cement slurry 111 is injected into the annulus 195 from the surface 108 in a reverse flow. Example embodiments allow for the reverse flow of the cement slurry down into the annulus 195 without the use of the rig 192.

As of the point in time that is shown in FIGS. 1A and 1B, the rig 192 is used to insert the casing string 115-3 into the wellbore 122. The burst disc 155 of the burst disc sub 150 is in its default state from the time that the burst disc 155 is added to the tubing string 115-3 until after the tubing string 115-3 is completely inserted into the wellbore 122. As the casing string 115-3 is being inserted into the wellbore 122, casing fluid 119 is disposed in the top portion 112 of the cavity 120 above the burst disc 155. At this time, the bottom portion 113 of the cavity 120 and the annulus 195 are continuous and can be filled with casing fluid 119. The burst disc sub 150 can be positioned in the casing string 115-3 in such a way that, when the casing string 115-3 is fully inserted into the wellbore 122, the burst disc sub 150 is located some distance (e.g., 90 feet, 50 feet) from the bottom of the wellbore 122.

Figure 2:
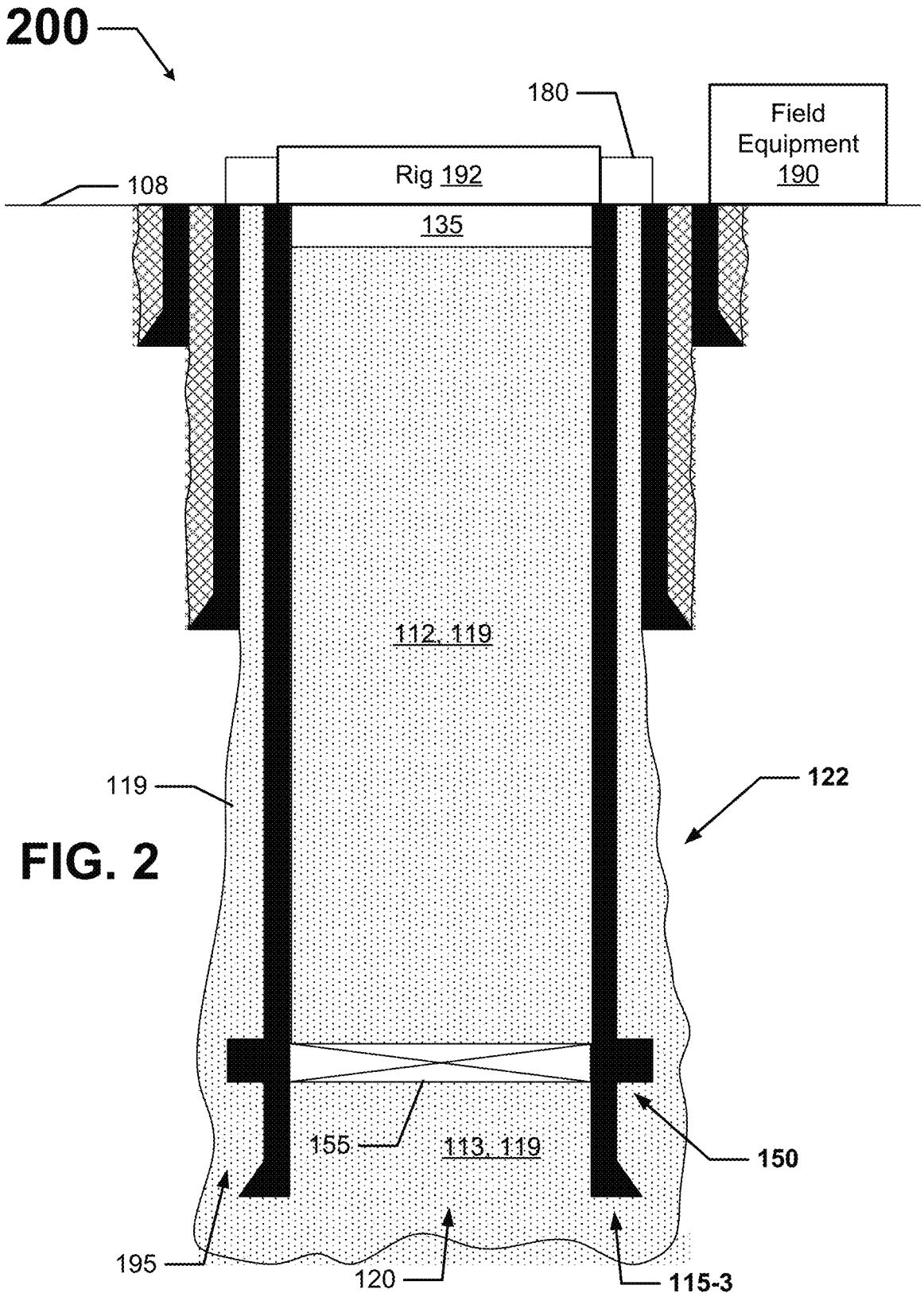
FIGS. 2 through 9 show sectional views of a system that includes the system of FIGS. 1A and 1B for subsequent stages of a wellbore cementing operation according to certain example embodiments.

FIGS. 2 through 9 show sectional views of a system that includes the system 100 of FIGS. 1A and 1B for subsequent stages of a wellbore cementing operation according to certain example embodiments. Referring to FIGS. 1A through 9, FIG. 2 shows a system 200 at a point in time that is subsequent to the time captured in FIGS. 1A and 1B. The system 200 of FIG. 2 shows that a barrier plug 135 (also called by other names, such as a back pressure valve 135) is inserted into the cavity 120 formed by the casing string 115-3 toward the top of the wellbore 122 near the surface 108.

Insertion of the barrier plug 135 into the cavity 120 suspends (maintains a pressure of) some of the casing fluid 119 within the top portion 112 of the cavity 120, as the burst disc 155 of the burst disc sub 150 remains in its default state. Also, since the burst disc 155 of the burst disc sub 150 remains in its default state, at least some of the casing fluid 119 in the bottom portion 113 of the cavity and the annulus 195 is displaced and flows out the casing valve 180, left in the open position, as the burst disc sub 150 is pushed toward the bottom of the wellbore 122. The rig 192 remains in place and may or may not be used to insert the barrier plug 135 into the cavity 120. In addition, or in the alternative, some of the field equipment 190 can be used to insert the barrier plug 135 into the cavity 120.

Figure 3:
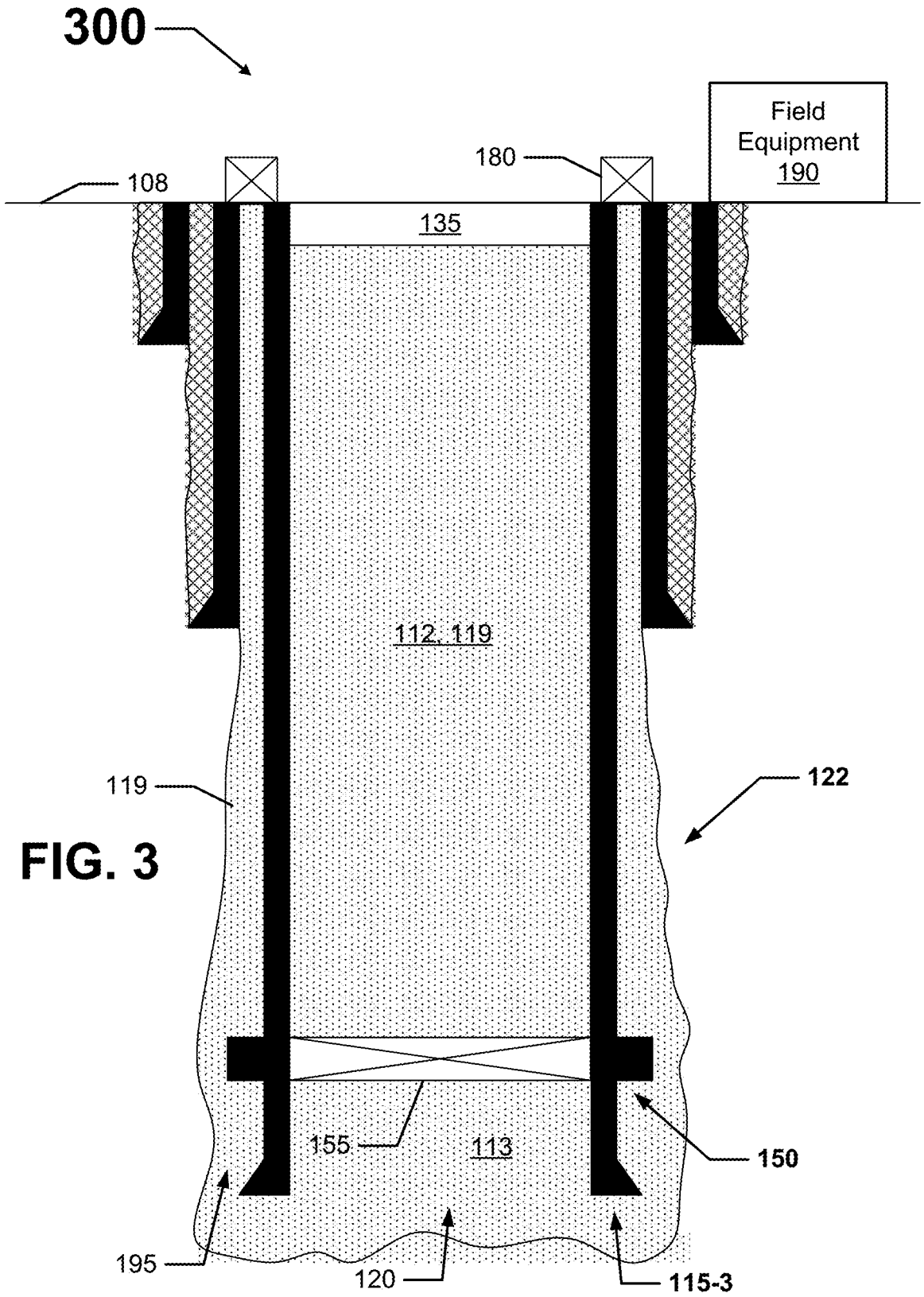

FIG. 3 shows a system 300 at a point in time that is subsequent to the time captured in FIG. 2. The system 300 of FIG. 3 shows that the barrier plug 135 remains inserted into the cavity 120 formed by the casing string 115-3 toward the top of the wellbore 122 near the surface 108. The system 300 of FIG. 3 also shows that the rig 192 has been removed (e.g., moved to another wellbore of a common pad). The rig 192 is a costly use item of equipment in a field operation, and so the sooner it can be moved from one wellbore (e.g., wellbore 122) to another, the more costs are saved. By having the burst disc sub 150 in the casing string 115-3 while the rig 192 is moved and prior to cementing, the unwanted and/or unexpected flow of fluids (e.g., casing fluid 119) up the inside (within the cavity 120) of the casing string 115-3 can be reduced or prevented. With the barrier plug 135 remaining inserted toward the top of the top portion 112 of the cavity 120, and with the burst disc 155 of the burst disc sub 150 remaining in its default state, some of the casing fluid 119 remains located in the annulus 195 and the bottom portion 113 of the cavity 120 once insertion of the burst disc sub 150 stops. While the rig 192 is moved, the casing valve 180 can be closed.

Figure 4:
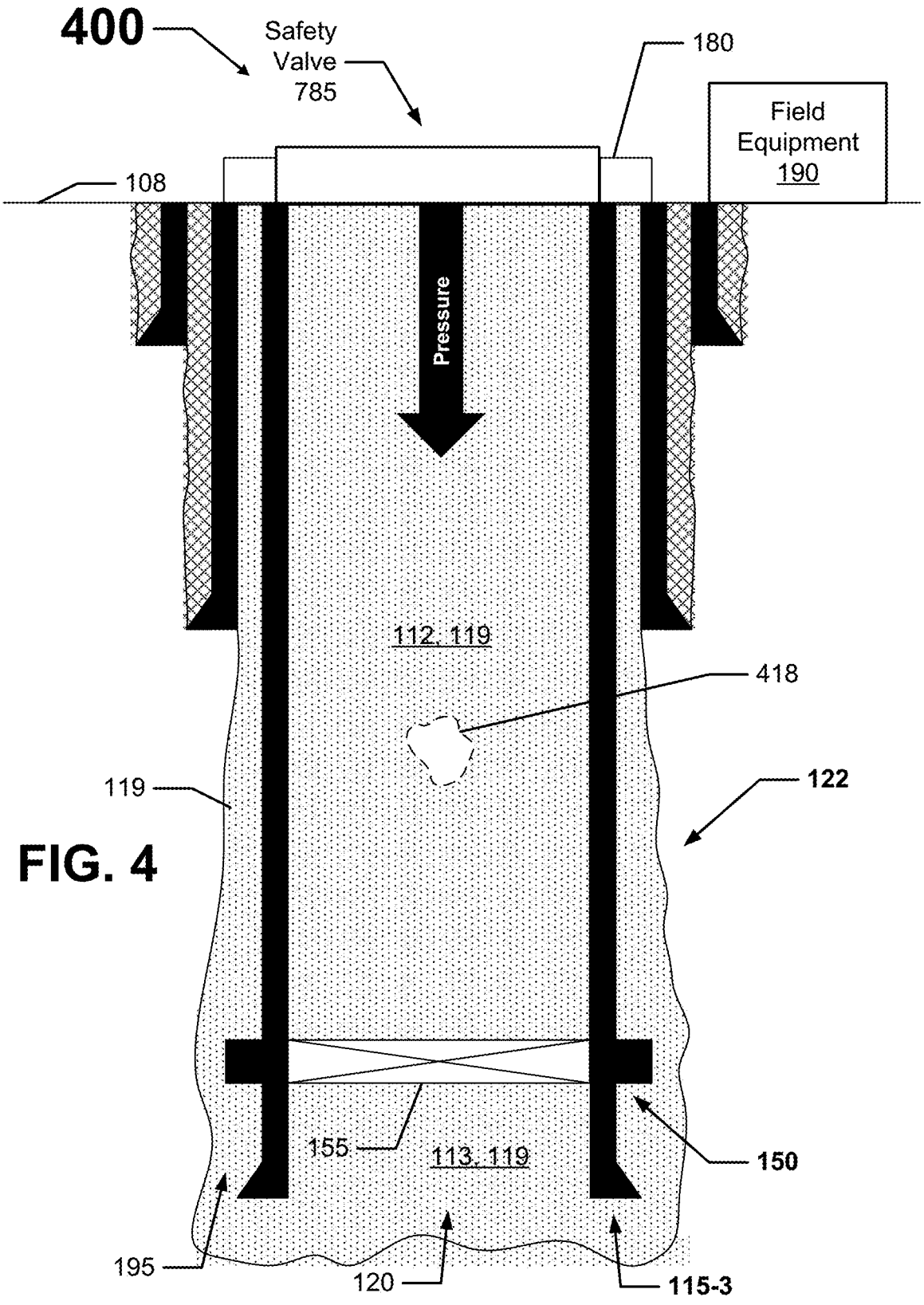

FIG. 4 shows a system 400 at a point in time that is subsequent to the time captured in FIG. 3. The system 400 of FIG. 4 shows that the barrier plug 135 has been removed from the cavity 120 formed by the casing string 115-3 and that a safety valve 785 (also called a full opening safety valve 785 or a FOSV 785) is installed at the surface 108 above the cavity 120 above where the barrier plug 135 was located. The removal of the barrier plug 135 and the insertion of the safety valve 785 can be performed, at least in part, by the field equipment 190. In addition, the system 400 of FIG. 4 shows that the casing valve 180 remains positioned at the top of the annulus 195 at the surface 108. With the barrier plug 135 removed, and with the casing valve 180 and the safety valve 785 placed in an open position, the field equipment 190 can be used to pump additional casing fluid 119 down into the top portion 112 of the cavity 120.

Figure 5:
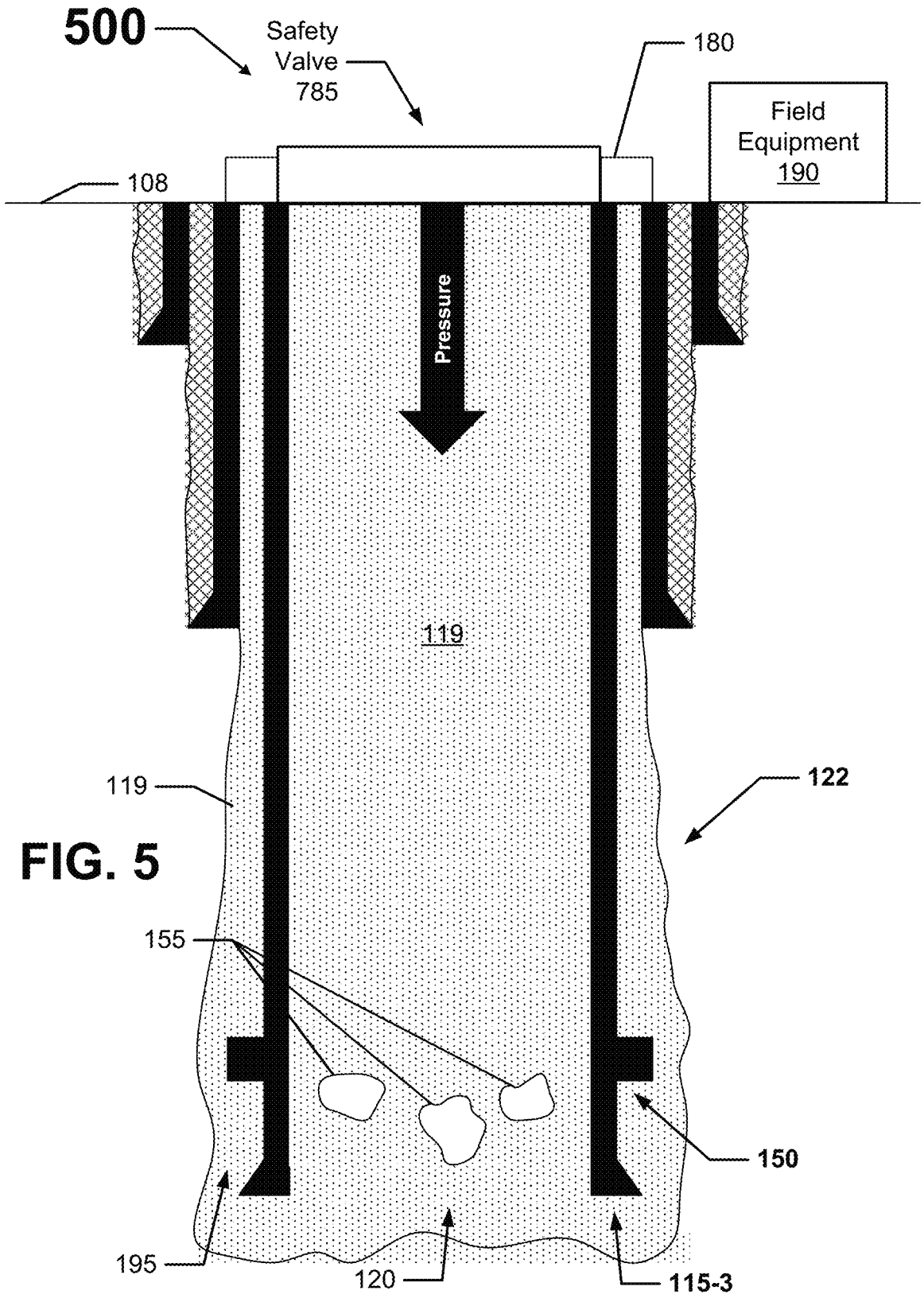

Since the burst disc 155 of the burst disc sub 150 remains in its default state, the pressure within the top portion 112 of the cavity 120 builds. When the pressure within the top portion 112 of the cavity 120 reaches a threshold value, which translates to the force applied by the casing fluid 119 against the burst disc 155 reaching a threshold value, the burst disc 155 breaks, as shown in FIG. 5 below. In alternative embodiments, as when the pressure generated within the top portion 112 of the cavity 120 is not sufficiently high to break apart the burst disc 155 or when a user (e.g., an operator) want to speed up the process of breaking apart the burst disc 155, one or more optional weighted objects 418 (e.g., rock, metal projectiles, a breaker bar) can be dropped into the cavity 120 at the surface 108. Such weighted objects 418 can have a mass sufficiently high to assist or be the sole cause in breaking apart the burst disc 155. While the burst disc 155 of the burst disc sub 150 remains in its default state, the annulus 195 and the bottom portion 113 of the cavity 120 are vacant or have some fluid other than the casing fluid 119.

In certain example embodiments, the diameter of the burst disc 155 of the burst disc sub 150 is no less than the inner diameter of the casing pipes 125 in the casing string 115-3. Further, the burst disc 155 of the burst disc sub 150 can be designed so that little if any of the burst disc 155 remains attached to the body 152 of the burst disc sub 150 when the burst disc 155 breaks apart. In this way, when the burst disc 155 breaks apart, as discussed below with respect to FIG. 5, none of the burst disc 155 (or what may remain of the burst disc 155) extends into the cavity 120 further than the inner surface of the casing pipes 125 of the casing string 115-3. As a result, the burst disc 155 does not inhibit subsequent field operations (e.g., another drilling phase of the wellbore 122).

FIG. 5 shows a system 500 at a point in time that is subsequent to the time captured in FIG. 4. Specifically, the system 500 of FIG. 5 shows the point in time just after the burst disc 155 of the burst disc sub 150 breaks apart. As a result, the cavity 120 becomes continuous between the top portion 112 and the bottom portion 113, which allows the casing fluid 119, still being injected by the field equipment 190 through the open safety valve 785, to flow downward past the burst disc sub 150 toward the distal end of the casing string 115-3. The casing valve 180 remains in the open position, allowing displaced casing fluid 119 in the annulus 195 and what was previously the bottom portion 113 of the cavity 120 to flow out of the wellbore 122 through the casing valve 180.

Figure 6:
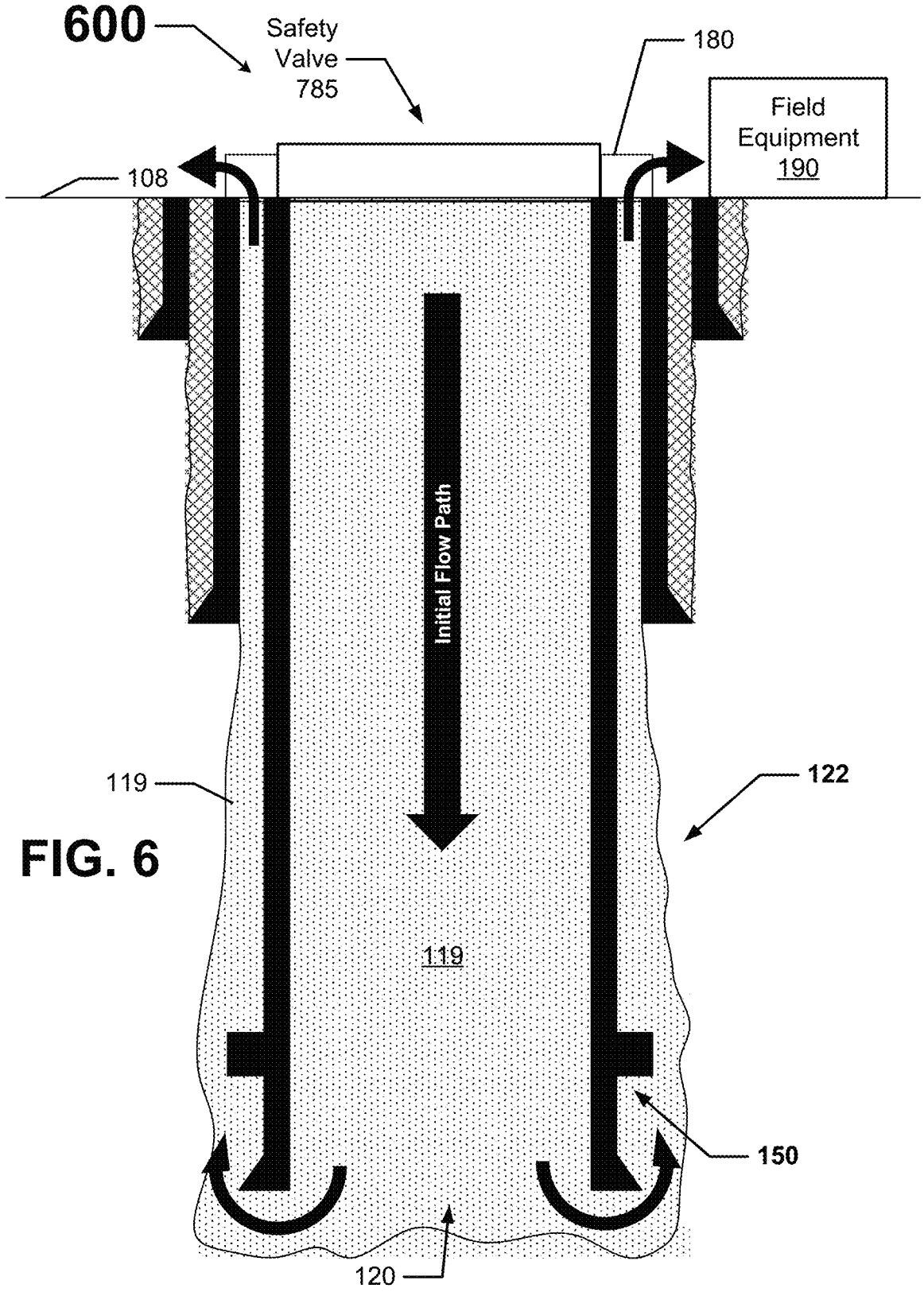

FIG. 6 shows a system 600 at a point in time that is subsequent to the time captured in FIG. 5. The system 600 of FIG. 6 shows that, as the casing fluid 119 continues to be injected through the open safety valve 785, using the field equipment 190, down into the cavity 120, the casing fluid 119 flows into the distal end of the wellbore 122, up the annulus 195, and through the casing valve 180 at the surface 108. This process continues until a user (e.g., an operator) is ensured that the casing fluid 119 fills all of the annulus 195, at which point the field equipment 190 is controlled to stop pumping the casing fluid 119 into the cavity 120. In some cases, the casing valve 180 can be closed so that the casing fluid 119 continues to fill the annulus 195 when the casing fluid 119 is no longer injected into the cavity 120.

FIG. 7 shows a system 700 at a point in time that is subsequent to the time captured in FIG. 6. The system 700 of FIG. 7 shows reverse circulation. The safety valve 785 remains in the open position before the reverse circulation begins. Using the field equipment 190, and with the casing valve 180 and safety valve 785 opened, a cement slurry 111 is injected down into the annulus 195 through the casing valve 180. When this occurs, the cement slurry 111 forces the casing fluid 119 down the annulus 195, into the cavity 120, up the cavity 120, and out of the cavity 120 through the safety valve 785 at the surface 108.

At some point, when the cement slurry 111 fills the annulus 195 but before the cement slurry 111 displaces a significant amount of the casing fluid 119 in the cavity 120, the field equipment 190 stops injecting the cement slurry 111 into the annulus 195. The trigger for stopping the injection of the cement slurry 111 into the annulus 195 can be based on one or more of a number of factors, including but not limited to the passage of time, a volume of cement slurry 111 injected into the annulus 195, and measurements made by one or more sensor devices (part of the field equipment 190). For example, the cement slurry 111 may be injected into the annulus 195 until the cement slurry 111 extends 100 feet to 500 feet into the cavity 120 from the bottom of the wellbore 122. The amount of cement slurry 111 injected into the annulus 195 during the duration of this stage of the cementing operation can referred to as a target volume.

FIG. 8 shows a system 800 at a point in time that is subsequent to the time captured in FIG. 7. In the system 800 of FIG. 8, the casing valve 180 at the top of the annulus 195 is closed, and the safety valve 785 at the top of the cavity 120 is also closed. This seals off the annulus 195 and the cavity 120, allowing the cement slurry 111 to cure and avoid contamination from elements at the surface 108.

FIG. 9 shows a system 900 at a point in time that is subsequent to the time captured in FIG. 8. In the system 900 of FIG. 9, the cement slurry 111 of FIGS. 7 and 8 has cured to form hardened cement 140-3, which cements the casing string 115-3 in the annulus 195 against the wall 109 of the wellbore 122 in the subterranean formation 110. In the time captured between what is shown in FIGS. 8 and 9, one or more tests can be performed on the well. To suspend the well and perform these tests (e.g., an inflow test) on the wellbore 122, including the cement slurry 111/hardened cement 140-3, the safety valve 785 can be opened. After the wellbore 122 (and, more specifically, the hardened cement 140-3) has been tested and the results of those tests are satisfactory, the safety valve 785 is removed, and the barrier plug 135 is reinserted to suspend the well so that the next stage of the subterranean field operation can commence. One or more of the next stages of the subterranean field operation relative to what is shown in FIG. 9 can involve moving the rig 192 back and using the rig 192 for those next stages. The hardened cement 140-3 that has formed within the cavity 120 outside the annulus 195 can be removed (e.g., drilled through, exploded, broken) as part of the next stage of the subterranean field operation.

Figure 10:
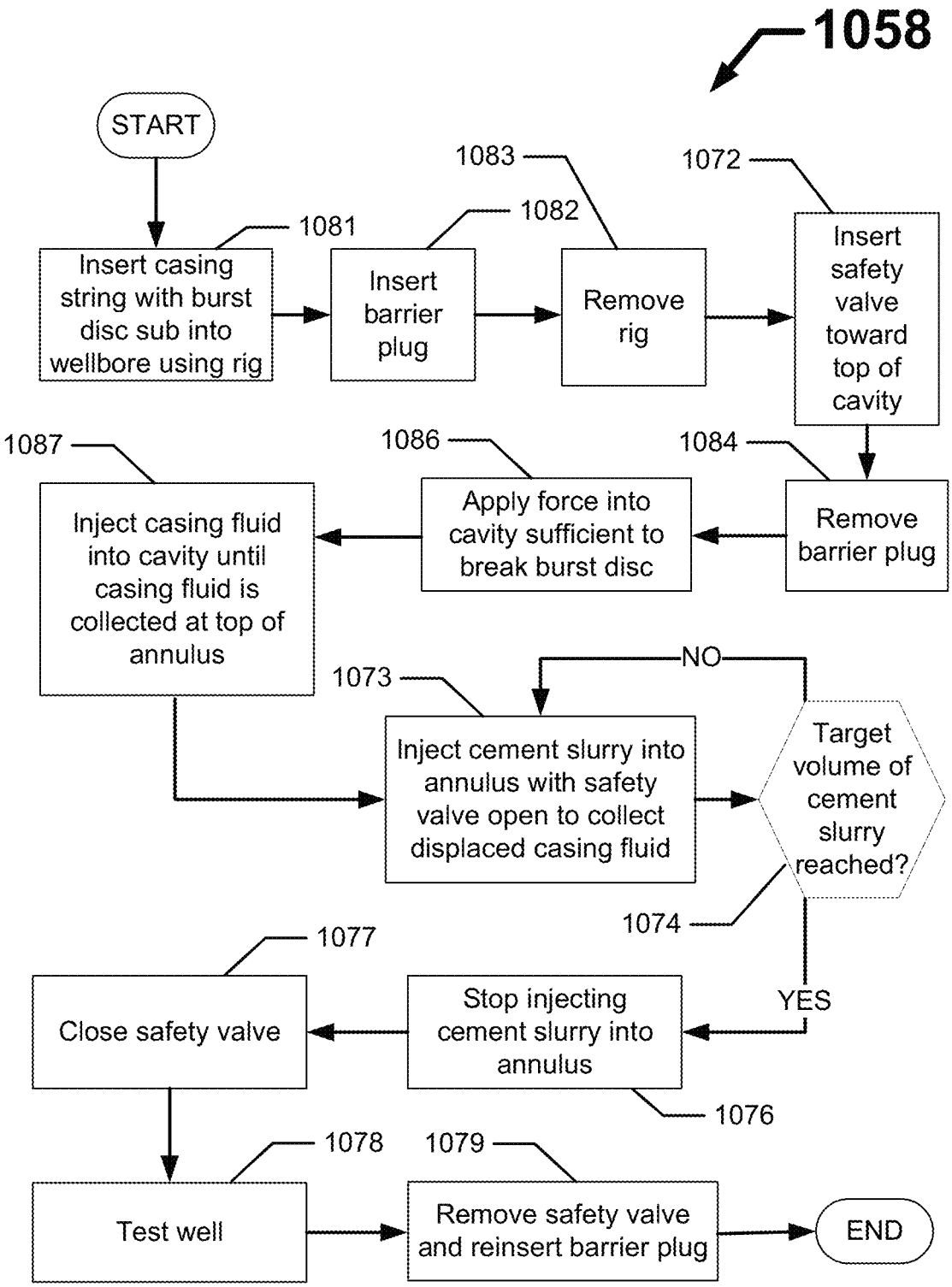
FIG. 10 shows a flowchart of a method for performing a wellbore cementing operation according to certain example embodiments.

FIG. 10 shows a flowchart 1058 of a method for performing a wellbore cementing operation according to certain example embodiments. While the various steps in this flowchart 1058 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 10 may be included in performing this method shown in the flowchart 1058. Accordingly, the specific arrangement of steps should not be construed as limiting the scope. Further, a controller or other type of computing device with a non-transitory computer readable medium can be used to perform one or more of the steps for the method shown in FIG. 10 in certain example embodiments. Any of the functions performed below by a controller can involve the use of one or more protocols, one or more algorithms, measurements from one or more sensor devices, and/or stored data stored in a storage repository. In addition, or in the alternative, any of the functions in the method can be performed by a user.

As used herein, a user can be any person that interacts, directly or indirectly, with a component of the system (e.g., system 100, system 600). Examples of a user may include, but are not limited to, an engineer, a company representative, a geologist, a consultant, a drilling engineer, a contractor, and a manufacturer's representative. A user can use one or more user systems, which may include a display (e.g., a GUI), other inputs, and/or other outputs, to perform one or more of the functions listed in the method of FIG. 10.

The method shown in FIG. 10 is merely an example that can be performed by using an example system described herein. In other words, systems for cementing casing using a burst disc sub and reverse circulation can perform other functions using other methods in addition to and/or aside from those shown in FIG. 10. Referring to FIGS. 1A through 10, the method shown in the flowchart 1058 of FIG. 10 begins at the START step and proceeds to step 1081, where a casing string 115-3 with a burst disc sub 150 is inserted into a wellbore 122 using a rig 192. The casing string 115-3 can be inserted into the wellbore 122 by or under the supervision of a user (e.g., a drilling engineer). In addition to the rig 192, the casing string 115-3 can be inserted into the wellbore 122 using field equipment 190. This step in the method coincides with what is shown and described above with respect to FIGS. 1A and 1B.

Other equipment, used in previous parts of a field operation, can remain in place and continue to be used during some or all of the steps in this method. For example, a casing valve 180, used as part of the wellhead in drilling the wellbore 122, can remain in place and be operated (e.g., opened, closed) during different steps in this method to help cement the casing using the burst disc sub 150 and reverse circulation. In this step 1081, the casing valve 180 can be placed in the open position to allow flow of displaced casing fluid 119 therethrough.

In step 1082, a barrier plug 135 is inserted. The barrier plug 135 can be inserted into the top portion 112 of the cavity 120 formed within the casing string 115-3 by a user. The barrier plug 135 can be inserted into the top portion 112 of the cavity 120 using field equipment 190. This step in the method coincides with what is shown and described above with respect to FIG. 2. In step 1083, the rig 192 is removed. The rig 192 can be removed by a user using field equipment 190. This step in the method coincides with what is shown in the time captured between FIGS. 2 and 3 above. In some cases, this step 1083 is an optional step.

In step 1072, a safety valve 785 is inserted at the top of the cavity 120. The safety valve 785 can be inserted by a user using field equipment 190. The safety valve 785 can be installed at or near the surface 108. The safety valve 785 can initially be in the open position, allowing a fluid (e.g., casing fluid 119) to flow therethrough. This step in the method coincides with what is shown in the time captured between FIGS. 3 and 4 above. In step 1084, the barrier plug 135 is removed. The barrier plug 135 can be removed from the top portion 112 of the cavity 120 formed within the casing string 115-3 by a user. The barrier plug 135 can be removed from the top portion 112 of the cavity 120 using field equipment 190. This step in the method coincides with what is shown in the time captured between FIGS. 3 and 4.

In step 1086, a force sufficient to break apart the burst disc 155 of the burst disc sub 150 is applied within the top portion 112 of the cavity 120 formed by the casing string 115-3. The force can be applied by pressurizing the casing fluid 119 using field equipment 190 (e.g., a pump, a compressor). In addition, or in the alternative, the force can be applied by one or more weighted objects 418 dropped into the top portion 112 of the cavity 120 near the surface 108. During this step, the casing valve 180 can remain in the open position. When the force is sufficient, the burst disc 155 of the burst disc sub 150 breaks apart. As a result, the top portion 112 and the bottom portion 113 of the cavity 120 become continuous. This step in the method coincides with what is shown and described above with respect to FIGS. 4 and 5.

In step 1087, casing fluid 119 is injected into the cavity 120 until the casing fluid is collected at the top of the annulus 195. The casing fluid 119 flows through the casing valve 180, still open when leaving the annulus 195. The casing fluid 119 can be injected into the cavity 120 at the surface 108 using field equipment 190. The casing fluid 119 can be injected into the cavity 120 by a user. When the casing fluid 119 stops being injected into the cavity 120, the casing valve 180 can be closed. This step in the method coincides with what is shown and described above with respect to FIG. 6.

In step 1073, a cement slurry 111 is injected into the annulus 195 with the safety valve 785 open to collect displaced casing fluid 119. The cement slurry 111 can be injected into the annulus 195 by a user using field equipment 190. During the step, the casing valve 180 and the safety valve 785 are in the open position, allowing the cement slurry 111 to flow through the casing valve 180 into the annulus 195, and also allowing displaced casing fluid 119 to flow out of the cavity 120 through the safety valve 785. This step in the method coincides with what is shown and described above with respect to FIG. 7.

In step 1074, a determination is made as to whether the target volume of cement slurry 111 has been reached. In other words, a determination is made as to whether there is enough cement slurry 111 to fill the annulus 195 along its entire length and also fill some amount (e.g., 100 feet, 500 feet) of the distal end of the cavity 120. The determination can be made by a user using a controller, measurements from one or more sensor devices, a timer, some other factor, or any suitable combination thereof. This step in the method coincides with what is shown and described above with respect to FIG. 7. If the target volume of cement slurry 111 has been reached, the process proceeds to step 1076. If the target volume of cement slurry 111 has not been reached, the process reverts to step 1073.

In step 1076, the injection of the cement slurry 111 into the annulus 195 is stopped. The injection of the cement slurry 111 into the annulus 195 can be stopped by a user directly or indirectly controller field equipment 190. Alternatively, the injection of the cement slurry 111 into the annulus 195 can be stopped by a controller. This step in the method coincides with what is shown and described above with respect to FIG. 7. In step 1077, the safety valve 785 is closed. The safety valve 785 can be closed by a user. Alternatively, or additionally, the safety valve 785 can be closed by a controller. Field equipment 190 can be used to close the safety valve 785. When the safety valve 785 is closed, the cavity 120 can be pressurized while the cement slurry 111 cures. This step in the method coincides with what is shown and described above with respect to FIG. 8.

In step 1078, the well is tested. The well (also called the wellbore 122) can be tested by a user using field equipment 190. Part of the testing of the well includes determining whether the cement slurry 111 has fully cured to form hardened cement 140-3 and the integrity of the casing string 115-3 in the wellbore 122. Part of the testing of the well can include an inflow test. During the testing of the well, the safety valve 785 can be opened. This step in the method coincides with what is shown in the time captured between FIGS. 8 and 9. If testing of the well does not yield satisfactory results to allow for subsequent stages of the field operation to proceed, one or more actions (including one or more steps in this method) can be taken to properly prepare the well so that the process can move forward.

In step 1079, the safety valve 785 is removed and the barrier plug 135 is reinserted into the cavity 120. The safety valve 785 can be removed and the barrier plug 135 can be reinserted by a user using field equipment 190. The well can then be prepared for additional stages to the field operation. One or more of the next stages of the subterranean field operation can involve moving the rig 192 back and using the rig 192 for those next stages. This step in the method coincides with what is shown and described above with respect to FIG. 9. When step 1079 is complete, the process can proceed to the END step.

Example embodiments can be used to provide wellbore cementing using a burst disc sub and reverse circulation. Example embodiments can be used in land-based or offshore field operations. Example embodiments also provide a number of other benefits. For instance, example embodiments can reduce or prevent unwanted and/or unexpected flow of fluids (e.g., casing fluid) up the inside of the casing string while running and moving a rig prior to cementing. Such other benefits can include, but are not limited to, less use of resources (such as a rig), time savings, cost savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system for cementing casing using reverse circulation, the system comprising:

a casing string disposed in a wellbore, wherein the casing string is inserted into the wellbore using a rig above an opening of the wellbore, wherein the casing string comprises:

a plurality of casing pipes; and a burst disc sub that is coupled to and disposed between two of the plurality of casing pipes toward a distal end of the casing string, wherein the burst disc sub comprises a burst disc that is disposed within a cavity formed in the casing string, wherein the burst disc provides a physical barrier in the cavity dividing the cavity into an upper portion and a lower portion when the burst disc is in a default state, wherein the burst disc, when exposed to a downward force in the upper portion of the cavity exceeding a threshold value, is configured to break apart to allow flow of casing fluid under pressure from the upper portion to the lower portion of the cavity through the burst disc sub, wherein the downward force is applied in the upper portion of the cavity using a pump and without the rig in place above the opening of the wellbore, wherein the burst disc sub is configured to allow for reverse flow of the casing fluid therethrough when a cement slurry is injected down an annulus formed between the casing string and a formation wall of the wellbore, and wherein the cement slurry is injected down the annulus using the pump and without the rig in place above the opening of the wellbore.

2. The system of claim 1, further comprising:

a casing valve located at a top of the annulus, wherein the casing valve is configured to allow the casing fluid to pass therethrough out of the annulus, and wherein the casing valve is further configured to subsequently allow the cement slurry to pass therethrough into the annulus.

3. The system of claim 2, wherein the casing valve is installed after a rig is removed from above an opening of the wellbore.

4. The system of claim 1, further comprising:

a safety valve located at the surface above the cavity, wherein the safety valve is configured to allow the casing fluid to leave the cavity when forced upward by the cement slurry as the cement slurry is injected into the annulus.

5. The system of claim 4, wherein the safety valve is closed to pressurize the cavity as the cement slurry cures to form hardened cement.

6. The system of claim 1, further comprising:

a barrier plug located toward a proximal end of the cavity, wherein the barrier plug is installed prior to removing a rig from above an opening of the wellbore, and wherein the barrier plug is removed prior to pressurizing the casing fluid.

7. The system of claim 1, further comprising:

field equipment located above the surface, wherein the field equipment comprises a pump for pumping the casing fluid under pressure.

8. The system of claim 7, wherein the field equipment further comprises a sensor device that is configured to measure a parameter associated with cementing the casing.

9. A method for cementing casing using reverse circulation for cementing with a burst disc as an internal barrier, the method comprising:

injecting a casing fluid under pressure from a surface into a cavity of a casing string disposed in a wellbore using a pump and without a rig in place above an opening of the wellbore, wherein the casing string comprises a plurality of casing pipes and a burst disc sub that is coupled to and disposed between two of the plurality of casing pipes toward a distal end of the casing string, wherein the burst disc sub comprises a burst disc that is disposed within a cavity formed by the casing string, wherein the burst disc provides a physical barrier in the cavity dividing the cavity into an upper portion and a lower portion when the burst disc is in a default state, and wherein the burst disc breaks apart after the casing fluid under pressure contacts the burst disc to allow flow of the casing fluid from the upper portion to the lower portion of the cavity through the burst disc sub; and injecting, after the casing fluid flows out of an annulus formed between the casing string and a formation wall of the wellbore at the surface, using the pump, and without the rig in place above the opening of the wellbore, a cement slurry into the annulus at the surface until the cement slurry flows into the cavity at the distal end of the casing string.

10. The method of claim 9, further comprising:

dropping a weighted object into the cavity from the surface to break apart the burst disc when the casing fluid under pressure is insufficient to break apart the burst disc.

11. The method of claim 9, wherein the cement slurry displaces a portion of the casing fluid in the cavity as the cement slurry is injected, and wherein the portion of the casing fluid exits the cavity through a safety valve at the surface.

12. The method of claim 11, further comprising:

closing the safety valve to pressurize the cavity as the cement slurry cures to form hardened cement.

13. The method of claim 9, further comprising:

opening a casing valve before injecting the casing fluid under pressure, wherein the casing valve is located at the surface at an opening of the annulus, and wherein the casing valve is configured to allow the casing fluid under pressure to pass therethrough out of the annulus.

14. The method of claim 13, wherein the casing valve is further configured to subsequently allow the cement slurry to pass therethrough into the annulus.

15. The method of claim 9, further comprising:

inserting, using a rig, the casing string into the wellbore prior to injecting the casing fluid under pressure.

16. The method of claim 15, further comprising:

removing the rig after inserting the casing string into the wellbore.

17. The method of claim 9, further comprising:

inserting a barrier plug toward a proximal end of the cavity near the surface.

18. The method of claim 17, further comprising:

removing a rig from above an opening of the wellbore; and removing, after removing the rig and before injecting the casing fluid under pressure, the barrier plug from the cavity.

19. A burst disc sub of a casing string, the burst disc sub comprising:

a body having a wall that forms a cavity, wherein a first end of the body is configured to couple to a first casing pipe in the casing string, and wherein a second end of the body is configured to couple to a second casing pipe in the casing string; and a burst disc coupled to an inner surface of the wall, wherein the burst disc provides a physical barrier in the cavity dividing the cavity into an upper portion and a lower portion when the burst disc is in a default state, wherein the burst disc, when exposed to a force from above in the cavity exceeding a threshold value, is configured to break apart, wherein the force is configured to be applied using a pump and without a rig in place above an opening of a wellbore, and wherein the body is configured to allow for reverse flow of casing fluid therethrough when a cement slurry is injected down an annulus formed between the casing string and a formation wall of the wellbore using the pump and without the rig in place above the opening of the wellbore.

* * * * *